US007845512B2

(12) United States Patent
Skala

(10) Patent No.: US 7,845,512 B2
(45) Date of Patent: Dec. 7, 2010

(54) THIN-WALLED CUP

(76) Inventor: Theodore P Skala, 4126 Columbia Squaref, North Olmsted, OH (US) 44070

( * ) Notice: Subject to any disclaimer, the term of this patent is extended or adjusted under 35 U.S.C. 154(b) by 862 days.

(21) Appl. No.: 11/503,686

(22) Filed: Aug. 14, 2006

(65) Prior Publication Data

US 2007/0199940 A1 Aug. 30, 2007

Related U.S. Application Data

(60) Provisional application No. 60/727,270, filed on Oct. 17, 2005.

(51) Int. Cl.
*B65D 1/24* (2006.01)

(52) U.S. Cl. ..... 220/703; 220/501; 220/505; 220/506; 220/507; 220/503

(58) Field of Classification Search ..... 220/501, 220/505, 506, 503, 507, 703, 23.83; 215/6; 222/129

See application file for complete search history.

(56) References Cited

U.S. PATENT DOCUMENTS

| | | | | |
|---|---|---|---|---|
| 1,168,027 | A | 1/1916 | Nirdlinger | |
| D99,531 | S | 5/1936 | Sterling | |
| 3,269,144 | A | 8/1966 | Poris | |
| 3,442,420 | A * | 5/1969 | Edwards | 206/520 |
| 3,651,202 | A * | 3/1972 | Raabe | 264/292 |
| 4,049,122 | A * | 9/1977 | Maxwell | 206/519 |
| 4,405,058 | A * | 9/1983 | Phalin | 220/62.13 |
| 4,410,085 | A * | 10/1983 | Beneziat et al. | 206/217 |
| 4,703,849 | A * | 11/1987 | Vezirian et al. | 206/217 |
| 4,928,848 | A * | 5/1990 | Ballway | 220/23.87 |
| 5,405,030 | A | 4/1995 | Frazier | |
| 5,495,941 | A * | 3/1996 | Leonard | 206/366 |
| 5,769,311 | A * | 6/1998 | Morita et al. | 229/403 |
| D400,398 | S | 11/1998 | McNaughton | |
| 6,293,435 | B1 * | 9/2001 | Forsberg | 222/143 |
| 6,502,712 | B1 * | 1/2003 | Weber-Unger | 220/501 |
| 6,517,780 | B1 * | 2/2003 | Cortelazzo | 422/102 |
| 6,866,905 | B1 * | 3/2005 | Sandstrom et al. | 428/34.1 |
| D534,768 | S | 1/2007 | Mansfield | |
| D539,091 | S | 3/2007 | Mansfield | |
| D541,107 | S | 4/2007 | Mansfield | |
| 7,243,812 | B2 * | 7/2007 | Mansfield et al. | 220/501 |
| 2006/0021986 | A1 | 2/2006 | Mansfield et al. | |
| 2006/0169700 | A1 | 8/2006 | Mansfield et al. | |
| 2007/0251946 | A1 * | 11/2007 | Urquhart et al. | 220/254.6 |
| 2007/0267424 | A1 * | 11/2007 | Marks | 220/703 |

* cited by examiner

*Primary Examiner*—Anthony Stashick
*Assistant Examiner*—Kareen Rush
(74) *Attorney, Agent, or Firm*—Tarolli, Sundheim, Covell & Tummino LLP

(57) ABSTRACT

A thin-walled cup is formed of a single piece of polymeric material having a uniform thickness throughout the extent of the single piece of polymeric material. The cup has an outer chamber which extends around an inner chamber. The outer chamber holds a first liquid and the inner chamber holds a second liquid. The liquid in the inner chamber is mixed with the liquid in the outer chamber during drinking from the cup.

3 Claims, 2 Drawing Sheets

THIN-WALLED CUP

RELATED APPLICATION

The benefit of earlier filed Provisional Application No. 60/727,270, filed on Oct. 17, 2005 by Theodore P. Skala is hereby claimed. The disclosure in the aforementioned Provisional Application is hereby incorporated herein in its entirety by this reference thereto.

BACKGROUND OF THE INVENTION

The present invention relates to a new and improved drinking cup and more specifically a drinking cup having inner and outer chambers which hold different liquids prior to drinking from the cup.

It has previously been suggested that a drinking cup or vessel may have an inner cup which receives liquor and an outer receptacle which extends around the inner cup and receives water or other liquids. Upon drinking from the vessel, the liquor in the inner cup is mixed with the water in the outer receptacle. A drinking vessel having such a construction is illustrated in U.S. Pat. No. 1,168,027. Another drinking cup or vessel is illustrated in U.S. Design Pat. No. 400,398.

SUMMARY OF THE INVENTION

The invention relates to a thin-walled cup which is integrally formed from a single piece of polymeric material having a uniform thickness. The cup includes a circular outer side wall which extends between a circular outer rim portion and an annular bottom wall of the cup. The outer side wall and bottom wall have the same thickness.

The cup also includes a first circular inner side wall which extends from the annular bottom wall to a circular inner rim portion. A second circular inner side wall extends from the circular inner rim portion to a circular inner bottom wall. The first and second circular inner side walls and the circular inner bottom wall have the same thickness as the circular outer side wall.

The circular inner rim portion includes upper and lower side surface areas having coincident centers of curvature. The upper and lower arcuate side surface areas of the inner rim portion are spaced apart by distance which is equal to the thickness of the circular outer side wall.

The second circular inner side wall and the circular inner bottom wall at least partially define an inner chamber which receives a first liquid. The circular outer side wall and the annular bottom wall at least partially define an outer chamber which extends around the inner chamber and receives a second liquid.

BRIEF DESCRIPTION OF THE DRAWINGS

The foregoing and other features of the invention will become more apparent upon a consideration of the following description taken in connection with the accompanying drawings wherein.

DESCRIPTION OF ONE SPECIFIC PREFERRED EMBODIMENT OF THE INVENTION

Figure 1:
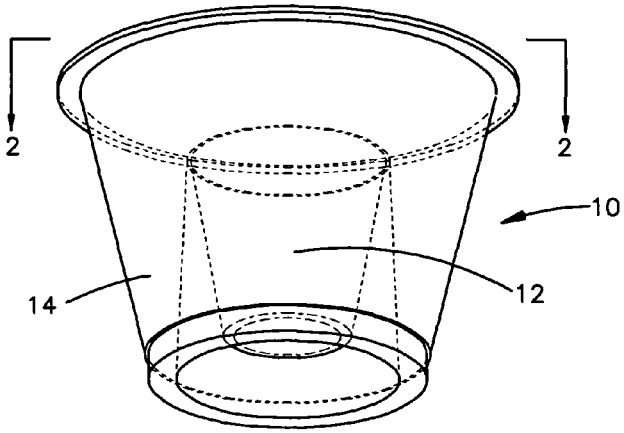
FIG. 1 is a schematic pictorial illustration of a thin-walled cup constructed in accordance with the present invention.
Figure 2:
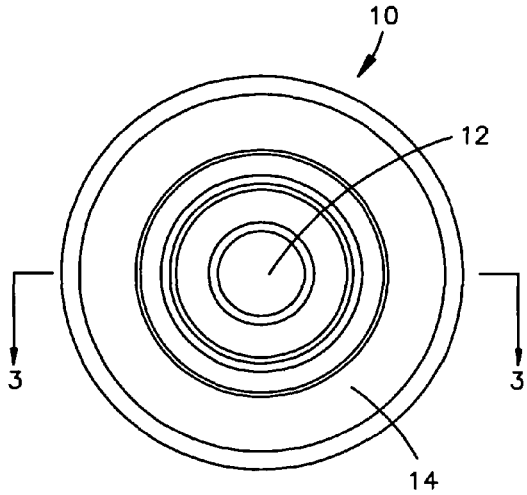
FIG. 2 is a plan view, taken generally along the line 2-2 of FIG. 1, further illustrating the construction of the cup.
Figure 3:
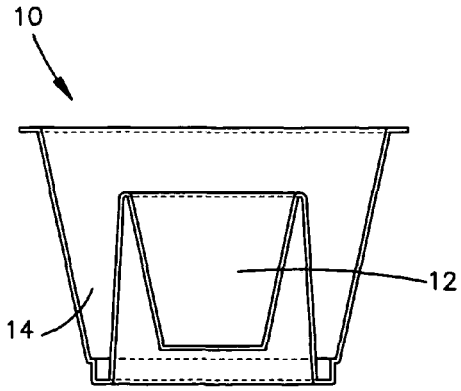
FIG. 3 is a sectional view, taken generally along the line 3-3 of FIG. 2, further illustrating the construction of the cup.

A thin-walled cup 10 (FIG. 1) is integrally formed of a single piece of polymeric material. The single piece of polymeric material has a uniform thickness throughout the extent of the single piece of polymeric material. The thin-walled cup 10 has an inner chamber 12 (FIGS. 1-4) which receives a first liquid, such as an alcoholic liquor. A second or outer chamber 14 extends around the first or inner chamber 12 and receives a second liquid, such as an energy drink. The two liquids are poured into the inner and outer chambers 12 and 14 and are kept separate from each other prior to drinking of the liquids. When an individual drinks from the cup, the liquid in the inner chamber 12 is mixed with the liquid in the outer chamber 14.

Rather than keeping the two liquids separate until an individual drinks from the cup 10, the inner chamber 12 may be filled with the first liquid and then the second liquid may completely fill the second or outer chamber 14. Even though the liquid in the filled outer chamber 14 extends across the inner chamber 12, there is minimal mixing of the two liquids until the cup is tipped during drinking from the cup.

The cup 10 is molded by a thermoforming process. During the thermoforming process, a single sheet of polymeric material having a uniform thickness is positioned in a thermoform press. Upper and lower platens in the thermoform press mold at least a portion of the sheet of polymeric material to the configuration of the cup 10. The cup 10 is formed from at least a portion of a single piece of plastic material, such as polystyrene, polyethylene or polypropylene. Of course, polymeric materials other than the aforementioned polymeric materials may be utilized to form the cup 10 if desired.

Figure 4:
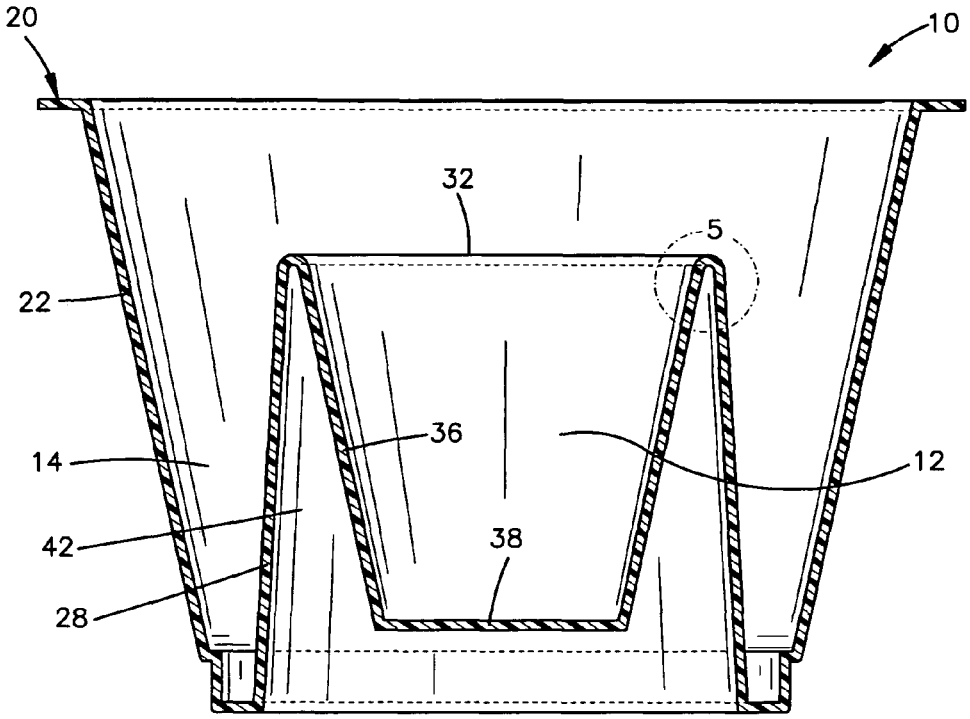
FIG. 4 is an enlarged sectional view, generally similar to FIG. 3, illustrating the uniform thickness of walls of the cup and the relationship between an inner chamber which receives a first liquid and an outer chamber which receives a second liquid.

The cup 10 includes a circular outer rim portion 20 (FIG. 4). A circular outer side wall 22 extends downward (as viewed in FIG. 4) from the circular rim 20 to an annular outer bottom wall 24 which is disposed in a coaxial relationship with the outer rim portion 20. The circular outer side wall 22 is formed as a portion of a right circular cone and tapers radially inward and axially downward (as viewed in FIG. 4) from the outer rim portion 20 toward the annular bottom wall 24. If desired, annular undulations may be formed in the outer side wall 22. The annular bottom wall 24 is integrally formed as one piece with the circular outer side wall 22 and has a uniform thickness which is the same as the uniform thickness of the circular outer side wall 22.

A first circular inner side wall 28 extends axially upward (as viewed in FIG. 4) and radially inward from the annular bottom wall 24. The first circular inner side wall 28 and bottom wall 24 are both disposed in a coaxial relationship with the outer rim portion 20. The first circular inner side wall 28 slopes radially inward and axially upward (as viewed in FIG. 4) from the annular bottom wall 24 of the cup 10. The first circular inner side wall 28 has a uniform thickness which is the same as the thickness of the annular bottom wall 24 and circular outer side wall 22.

The first circular inner side wall 28 ends at a circular inner rim portion 32. The circular inner rim portion 32 is disposed between the annular bottom wall 24 and the circular outer rim 20 of the cup 10. The circular inner rim portion 32 is offset downwardly (as viewed in FIG. 4) from the circular outer rim portion 20 and is disposed in a coaxial relationship with the circular outer rim portion 20. The circular inner rim portion 32 extends parallel to the circular outer rim portion 20 of the cup 10. The circular inner rim portion 32 has a uniform thickness throughout the extent of the circular inner rim portion.

A second circular inner side wall 36 slopes radially inward and axially downward from the circular inner rim portion 32 to a circular inner bottom wall 38. The second circular inner side wall 36 is formed as a portion of a right circular cone. The second circular inner side wall 36 has the same slope as the circular outer side wall 22. Therefore, the second circular inner side wall 36 is spaced the same radial distance from the circular outer side wall 22 throughout the extent of the second circular inner side wall. As viewed in a radial cross section plane (FIG. 4), the second circular inner side wall 36 extends parallel to the circular outer side wall 22.

The second circular inner side wall 36 has a uniform thickness throughout its extent. The uniform thickness of the second circular inner side wall 36 is the same as the thickness of the first circular inner side wall 28 and circular outer side wall 22. The second circular inner side wall 36 slopes inwardly away from the first circular inner side wall 28 so that there is a space 42 between the second circular inner side wall 36 and the first circular inner side wall 28 throughout the extent of the second circular inner side wall.

The circular inner bottom wall 38 is disposed in a coaxial relationship with and extends parallel to the annular bottom wall 24. In addition, the circular inner bottom wall 38 is disposed in a coaxial relationship with the circular inner rim portion 32 and circular outer rim portion 20. The circular inner bottom wall 38 extends parallel to the circular inner rim portion 32 and the circular outer rim portion 20.

The circular inner bottom wall 38 is flat and has a uniform thickness throughout its extent. The thickness of the circular inner bottom wall 38 is the same as the thickness of the second circular inner side wall 36 and the annular bottom wall 24.

Figure 5:
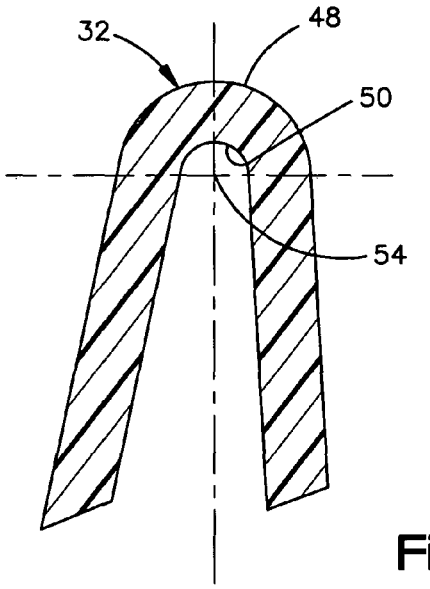
FIG. 5 is an enlarged fragmentary illustration of the portion of the cup enclosed by a circle designated by the numeral 5 in FIG. 4.

The circular inner rim portion 32 includes an arcuately curving outer or upper side surface 48 (FIG. 5) and an arcuately curving inner or lower side surface 50. The arcuately curving upper and lower side surfaces 48 and 50 of the circular inner rim portion 32 have coincident centers of curvature, indicated at 54 in FIG. 5. The arcuately curving upper and lower side surfaces 48 and 50 of the circular inner rim portion 32 are spaced apart by the same distance throughout their extent and throughout the extent of the circular inner rim portion 32. The radius of curvature of the arcuately curving upper side surface 48 exceeds the radius of curvature of the lower side surface 50 by an amount which is equal to the thickness of the first circular inner side wall 28 and the thickness of the second circular inner side wall 36.

The uniform thickness of the various walls of the cup 10 and the provision of the space 42 between the inner side walls 28 and 36 of the cup 10 enable a large number of the cups to be compactly stacked. When this is done, the circular rim portion 32 of one cup is positioned adjacent to and in engagement with the circular rim portion 32 of the next lower cup. When the cups are stacked in this manner, the circular inner bottom wall 38 is disposed in abutting engagement with the circular inner bottom wall of the next lower cup. Similarly, the annular bottom wall 24 of an upper cup 10 is disposed in engagement with the annular bottom wall 24 of the next lower cup.

When the cup 10 is to be filled with liquid, the annular bottom wall 24 is positioned on a level support surface, such as a table. A first liquid which may be a liquor, is poured into the inner chamber 12. The inner chamber 12 is filled with the first liquid to a level slightly below the circular rim portion 32. A second liquid, which may be water, beer, or an energy drink, is poured into the outer chamber 14. The outer chamber 14 is filled with the second liquid to a level slightly below the circular rim portion 32. This results in the liquids being kept separate until the cup is tipped to drink the liquids.

In view of the foregoing description, it is apparent that the present invention provides a thin-walled cup 10 which is integrally formed from a single piece of polymeric material having a uniform thickness. The cup includes a circular outer side wall 22 which extends between a circular outer rim portion 20 and an annular bottom wall 24 of the cup. The outer side wall 22 and bottom wall 24 have the same thickness.

The cup also includes a first circular inner side wall 28 which extends from the annular bottom wall 24 to a circular inner rim portion 32. A second circular inner side wall 36 extends from the circular inner rim portion 32 to a circular inner bottom wall 38. The first and second circular inner side walls 28 and 36 and the circular inner bottom wall 38 have the same thickness as the circular outer side wall 22.

The circular inner rim portion 32 includes arcuate upper and lower side surface areas 46 and 50 having coincident centers of curvature. The upper and lower arcuate side surface areas 48 and 50 of the inner rim portion 32 are spaced apart by distance which is equal to the thickness of the circular outer side wall 22.

The second circular inner side wall 36 and the circular inner bottom wall 38 at least partially define an inner chamber 12 which receives a first liquid. The circular outer side wall 22 and the annular bottom wall 24 at least partially define an outer chamber 14 which extends around the inner chamber 12 and receives a second liquid.

Having described the invention, the following is claimed:

1. A thin-walled cup formed from a single piece of polymeric material having uniform thickness throughout the extent of said single piece of polymeric material, said cup comprising a circular outer side wall which extends between a circular outer rim portion and an annular outer bottom wall of said cup, said circular outer side wall and said annular bottom wall having the same thickness, a first circular inner side wall extending from said annular bottom wall to a circular inner rim portion, said circular inner rim portion is disposed in a coaxial relationship with said circular outer rim portion and is axially offset from said circular outer rim portion in a direction toward said annular outer bottom wall, said circular inner rim portion having a uniform cross sectional configuration throughout the extent of said circular inner rim portion, a second circular inner side wall extending from said circular inner rim portion to a circular inner bottom wall, said first circular inner side wall being spaced apart from said second circular inner side wall throughout the extent of said first circular inner side wall, said first and second circular inner side walls and said circular inner bottom wall having the same thickness as said circular outer; side wall, said circular inner rim portion having an arcuate upper side surface area and an arcuate lower side surface area as viewed in a radial plane containing a central axis of said cup, said arcuate upper and lower side surface areas having coincident centers of curvature which are spaced apart from the central axis of said cup, said coincident centers of curvature of said arcuate upper side surface area and said arcuate lower side surface area being disposed at a location which is beneath said arcuate lower side surface area and which is intermediate and is spaced apart from said first and second circular inner side walls, said second circular inner side wall and said circular inner bottom wall at least partially defining an inner chamber which receives a first liquid and said circular outer side wall and said annular outer bottom wall at least partially defining an outer chamber which extends around said inner chamber and which receives a second liquid which is different than the first liquid.

2. A thin-walled cup as set forth in claim 1 wherein said coincident centers of curvature of said arcuate upper and lower surface areas on said circular inner rim portion are disposed further from said arcuate upper side surface area than said arcuate lower side surface area.

3. A thin-walled cup as set forth in claim 1 wherein said arcuate upper side surface area on said circular inner rim portion has a larger radius of curvature than said arcuate lower side surface area on said circular rim portion.

* * * * *